United States Patent [19]

Booth et al.

[11] Patent Number: 4,573,517

[45] Date of Patent: Mar. 4, 1986

[54] FIBER-REINFORCED METALS

[75] Inventors: Stuart E. Booth, Wantage; Andrew W. Clifford, Weymouth; Noel J. Parratt, Loughton, all of England

[73] Assignee: The Secretary of State for Defence in Her Britannic Majesty's Government of the United Kingdom of Great Britain and Northern Ireland, London, England

[21] Appl. No.: 541,319

[22] Filed: Oct. 11, 1983

[51] Int. Cl.[4] ..... B22D 17/00; B22D 19/00

[52] U.S. Cl. ..... 164/61; 164/98; 164/105; 164/113; 164/256

[58] Field of Search ..... 164/61–63, 164/66.1, 113, 119, 133, 256–258, 306–311, 98, 100, 103, 105, 108, 109

[56] References Cited

U.S. PATENT DOCUMENTS

| | | | |
|---|---|---|---|
| 2,821,757 | 2/1958 | Wood | 164/61 |
| 2,912,728 | 11/1959 | Sylvester | 164/62 |
| 3,547,180 | 12/1970 | Cochran et al. | 164/97 |
| 3,553,820 | 1/1971 | Sara | 29/527.2 |
| 3,650,313 | 3/1972 | Balevski et al. | 164/119 |
| 3,862,656 | 1/1975 | Weiler et al. | 164/62 |
| 3,913,657 | 10/1975 | Banker et al. | 164/68.1 |
| 3,951,199 | 4/1976 | Pereira | 164/119 |
| 4,476,916 | 10/1984 | Nusbaum | 164/108 |

*Primary Examiner*—Nicholas P. Godici
*Assistant Examiner*—R. K. Seidel
*Attorney, Agent, or Firm*—William R. Hinds

[57] ABSTRACT

A fiber reinforced metal is made by introducing an array of fibers into a die, charging the die with molten metal by vacuum infiltration and then applying pressure by means of an inert gas to improve the penetration of the molten metal into the fiber array. Apparatus for producing a reinforced metal cylinder comprises a cylindrical former (2) onto which a composite fiber (3) of boron, silicon and carbon is wound. The former (2) forms an inner closure member for the die defining a cylindrical die cavity (8) with an outer die body (4). A central cavity (15) within the former (2) is for insertion of a heating element to facilitate the flow of metal through the cavity (8). The die cavity is evacuated via conduit (16) and molten metal is then drawn into the cavity via the passage (7). After charging the die with molten metal the conduit (16) is connected to a source of high pressure nitrogen. The die is then cooled while maintaining the pressure in the die cavity making use of a cooling stalk which replaced the heating element inside the spool.

4 Claims, 5 Drawing Figures

FIBER-REINFORCED METALS

This application is a continuation of copending International Application No. PCT/GB83/00031 filed Feb. 4, 1983, designating the United States as a designated state. Said International Application is abandoned as to the United States national stage. The benefit of the filing date of said International Application is claimed under 35 U.S.C. §365(c) and 35 U.S.C. §120.

The invention relates to the manufacture of composite materials comprising a metal matrix incorporating a reinforcing material, particularly elongated single crystal fibres of refractory materials.

UK Pat. No. 1334358 describes the manufacture of metal composites by processes involving the application of a defined pressure programme to an admixture of the molten metal and particulate reinforcing material in a mould. By subsequent extrusion of the cast composite billet it is possible to align some of the reinforcing fibres in the direction of the extrusion, resulting in an improvement of the strength and stiffness of the composite as compared with the unreinforced metal. However, because of the difficulty experienced in obtaining high concentrations of fibre and the breakage of fibres during the extrusion process the strength and stiffness of the composite were considerably less than might have been expected.

UK Pat. No. 1359554 disclosed a method for improving the strength and stiffness of composite materials by providing a predetermined pattern of reinforcing fibre in a mould and then applying pressure to a charge of molten metal to force it through the fibres to give a composite. In practice it had been found that it was extremely difficult to force the molten metal to penetrate the fibres, without breaking them. The invention sought to overcome this problem by separating the fibres such that there existed a maximum penetration distance through the fibres commensurate with the flow characteristics of the metal.

Both prior art processes described above adopted mechanical pressure applied directly by a piston to a charge of molten metal to promote penetration by the metal into the array of fibres. However, because of losses in the system the nominal pressure applied was found to be greater than the pressure applied to the liquid metal inside the mould cavity.

It is an object of the present invention to improve penetration of the fibres by molten metal and to reduce the pressure losses involved when pressurising the liquid metal. This will improve the properties of a metal composite casting and allow thinner die components to be used.

The invention provides a process for forming a composite material comprising a metal matrix incorporating a non-metallic fibrous reinforcement material including the steps of providing in a die at least one layer of the fibrous reinforcement material, evacuating the die to remove gas from the mould chamber, sucking metal up into the die to fill it under the action of the partial vacuum in the die and applying pressure to the contents of the die by means of a compressed gas so as to force molten metal to surround substantially all of the fibres of the layer.

Preferably the molten metal is maintained at a constant temperature above the metal liquidus to promote flow penetration of the metal between the fibres. The temperature of the molten metal may be controlled by providing a heating jacket which surrounds the die.

More particularly, the invention disclosed and claimed in this application provides a process for forming a composite material comprising a metal matrix incorporating a non-metallic fibrous reinforcement material including the steps of providing in a mould chamber at least one layer of the fibrous reinforcement material, connecting the mould chamber via a liquid metal conduit to an air-tight furnace substantially at the base of the mould chamber; evacuating the furnace to thereby evacuate the mould chamber via the metal conduit; heating the mould chamber and fibrous material to a temperature above the solidus temperature of the metal; connecting the furnace to a source of gas at a relatively low pressure to thereby force molten metal immersing the end of the conduit in the furnace to substantially fill the mould chamber under the combined action of the partial pressure in the mould chamber and the relatively low pressure of the gas applied to the molten metal; and finally pressurizing the gas to thereby pressurize the molten metal in the mould chamber so as to force molten metal to surround substantially all of the fibres of the layer. The process may include the step of cooling the mould chamber while applying the relatively higher pressure to the molten metal, the cooling being controlled to ensure directional solidification of the molten metal. The gas may be air or an inert gas where it is desired to re-use surplus metal.

In one form suitable for producing composite metal tubes, the reinforcing material comprises a fibre which is wound around a cylindrical former to form a cylindrical fibre layer. In order to promote the flow of molten metal around the fibres in the layer the former is preferably provided with longitudinal grooves in its outer surface such that the molten metal can flow through the grooves and penetrate the fibre layer radially from the inner as well as the outer surface.

Advantageously the die is cooled at a controlled rate to ensure directional solidification of the molten metal. Preferably the cooling is done by introducing coolant through the central axis of the former. In a preferred arrangement the former is at least partly hollow such that a cooling stalk can be inserted into the former. The cooling stalk may be replaced by a heating element for raising the die temperature prior to the introduction of the molten metal so as to maintain the temperature of the molten metal.

In order to minimise the thermal stresses occuring during cooling of the former the die is preferably arranged such that it includes at least one seal capable of permitting relative movement between the former and the die. Advantageously the said seal is at the upper end of the die, the charge of molten metal being limited such that molten metal does not contact said seal. Preferably the gas in contact with the metal is inert.

In order that these and other features may be appreciated embodiments of the invention will now be described by way of example only with reference to the following drawings of which:

FIG. 1 shows the die 1 which has been devised for the making of fibre-reinforced metal tubes. The materials selected for the tubes are Borsic fibres, composed of boron, silicon and carbon, and aluminium alloy.

Figure 1:
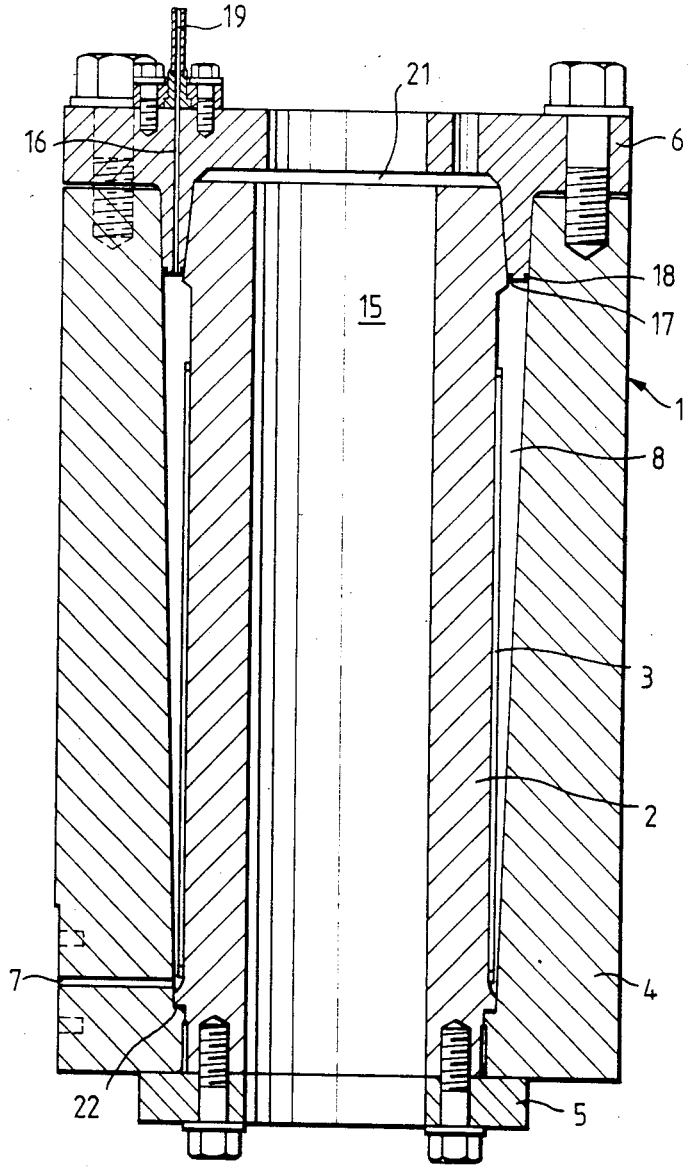
FIG. 1 is a cross sectional view of a die for producing a composite metal cylinder.

A Borsic fibre is wound around a steel former 2 to form a cylindrical fibre array 3. The former is then inserted into the die 1. The die 1 is formed by a hollow cylindrical body 4 in which are bolted end plates 5 and 6. Molten aluminum alloy is introduced into the die 1 through the opening 7 in the lower portion of the cylindrical body 4 and is drawn up through a cylindrical space 8 surrounding the former 2 and the fibre array 3 until the fibre array is entirely covered by the molten metal. During this process it is necessary to maintain the temperature of the die such that the molten metal flows freely. Once the required charge of molten metal has been introduced into the die the molten metal is pressurised by a compressed inert gas so as to force the molten metal to flow through the fibre array 3 to form an intimate metal matrix linking the array.

Figure 2:
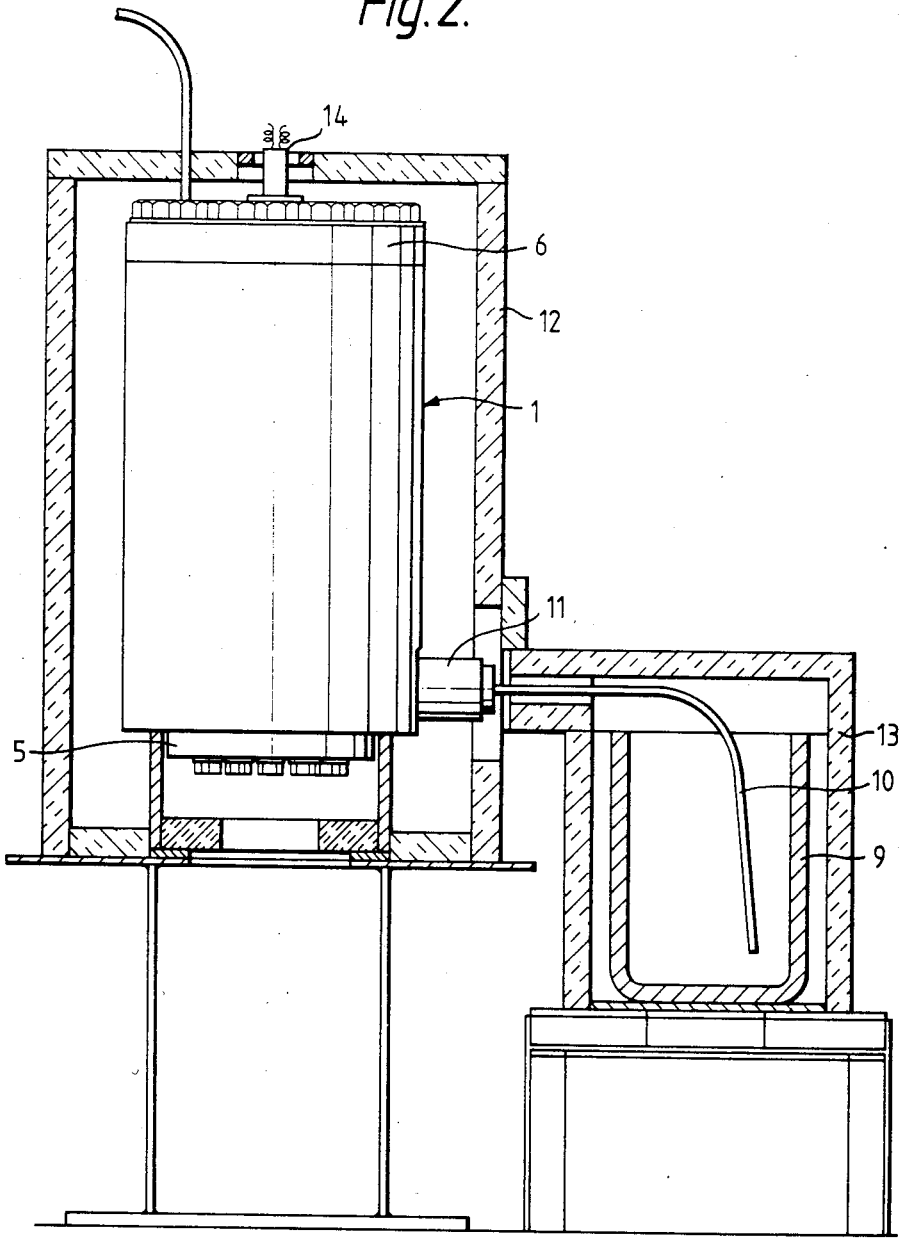
FIG. 2 is a cross sectional view taken through the heating jackets surrounding the die and a crucible for melting the metal.

The die is charged with molten metal as can be seen with further reference to FIG. 2. Aluminium alloy is first melted and is then degassed. The molten metal is then transferred to a crucible 9. A tube 10 for introducing the molten metal into the die is inserted into the crucible and is connected to the opening 7 in the die 1 by a valve 11. The die 1 and crucible 9 are surrounded by heating jackets 12 and 13 to maintain the temperature of the aluminium alloy at 650° C. to 700° C. Heating elements 14 are inserted through the heating jacket 12 and the upper end plate 6 into the hollow interior 15 of the former 2 to maintain uniformity of temperature within the die. The space 8 within the die 1 is evacuated with the valve 11 in the closed position by connecting a conduit 16 which passes through the die top plate to a reservoir connected to a vacuum pump. The die is charged by opening the valve 11 to draw metal up into the die by virtue of the difference between the pressure in the mould chamber and atmospheric pressure acting on the metal in the crucible. The valve 11 is provided with two flow rate settings. The die is filled with the valve fully open until the metal just covers the fibre array and then the flow is adjusted to a slower rate until the metal level reaches a position just below the seals 17 and 18 between the top plate 6 and respectively the former 2 and the body 4 of the die. The use of a controlled slow fill to the final level ensures that molten metal does not contact the die seals 17 and 18. A valve made by Flexitallic (Trade Name) is used fitted with special seals which are stable up to 900° C.

Two probes (not shown) are provided at appropriate heights in the wall of the body of the die to respectively determine the change from the initial metal flow rate to the final metal flow rate and then the valve closure.

Figure 3:
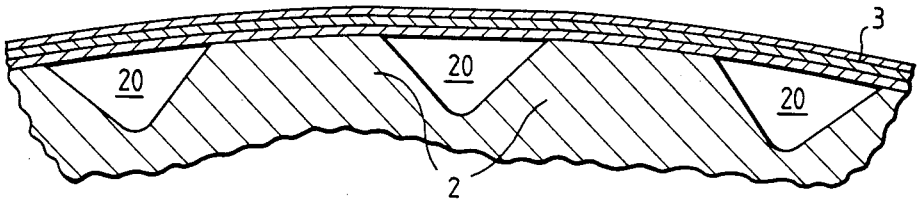
FIG. 3 is a partial cross sectional view of the surface of the former shown in FIG. 1.

The conduit 16 is connected to the vacuum reservoir via a metal tube 19, a flexible hose (not shown) and a three-way valve (not shown). After charging the die with molten metal the three-way valve is reset to connect to the die a gas bottle containing inert gas such as argon at a pressure of 15 $N/mm^2$. The gas pressure is applied to the molten metal to improve the penetration of the metal between the fibre windings such that the Borsic fibre becomes entirely embedded within the molten metal. In order to further improve the metal penetration into the fibre array the outer surface of the former 2 is provided with longitudinal grooves 20 as can be seen in FIG. 3. Under the influence of the partial vacuum during the charging of the die, molten metal flows up through the grooves 20 within the fibre array as well as through the annular space 8 surrounding the fibre array. On pressurising the die molton metal is then able to penetrate the fibre array from radially inside as well as from outside the array.

After pressurising the die cavity the heating elements 14 are removed from within the interior 15 of the former 2 and a cooling stalk is inserted. Air is passed through the cooling stalk while the temperature of the die is monitored. By varying the flow rate and/or the temperature of the cooling gas the molten metal is cooled at a controlled rate ensuring directional solidification by virtue of the axial cooling of the former. Once the metal has solidified the gas pressure is removed and the heating jackets are removed to allow the casting and the die to cool.

Cooling of the former may alternatively be done by passing water through the cooling stalk. Stress within the die arises principally as a result of differential thermal contraction during the forced cooling of the former. This stress is minimised according to the design shown in FIG. 1 by concentrating thermal movement in the region of the seal 17 between the former and the top end plate 6 of the die. Thus an expansion space 21 is provided between the top of the former 2 and the top end plate 6. The seal 17 must therefore be capable of maintaining integrity during expansion and contraction of the former and to be effective at high temperatures. Since the metal level is kept below the level of the seal this requirement is less stringent. A seal known as Helico flex is used. This makes use of a spring with a metal facing so as to be capable of retaining gas pressure within the die during the longitudinal and radial contraction of the former due to the forced cooling. The seal 22 at the base of the die is made by a conventional spiral-wound stainless steel-asbestos type of seal such as the Flexitallic seal. Thus by providing efficient seals between the former and the die and adapting the seals to be capable of accepting any thermal expansion movement of the former, pressure losses are minimised and the pressure exerted on the molten metal is substantially equal to the nominal applied pressure.

The apparatus thus far described for carrying out the process of the invention utilises a valve in the liquid metal conduit. Alternative arrangements are shown in FIGS. 4 and 5 which obviate the necessity for a liquid metal valve and thus avoid the consequent sealing problems.

Figure 4:
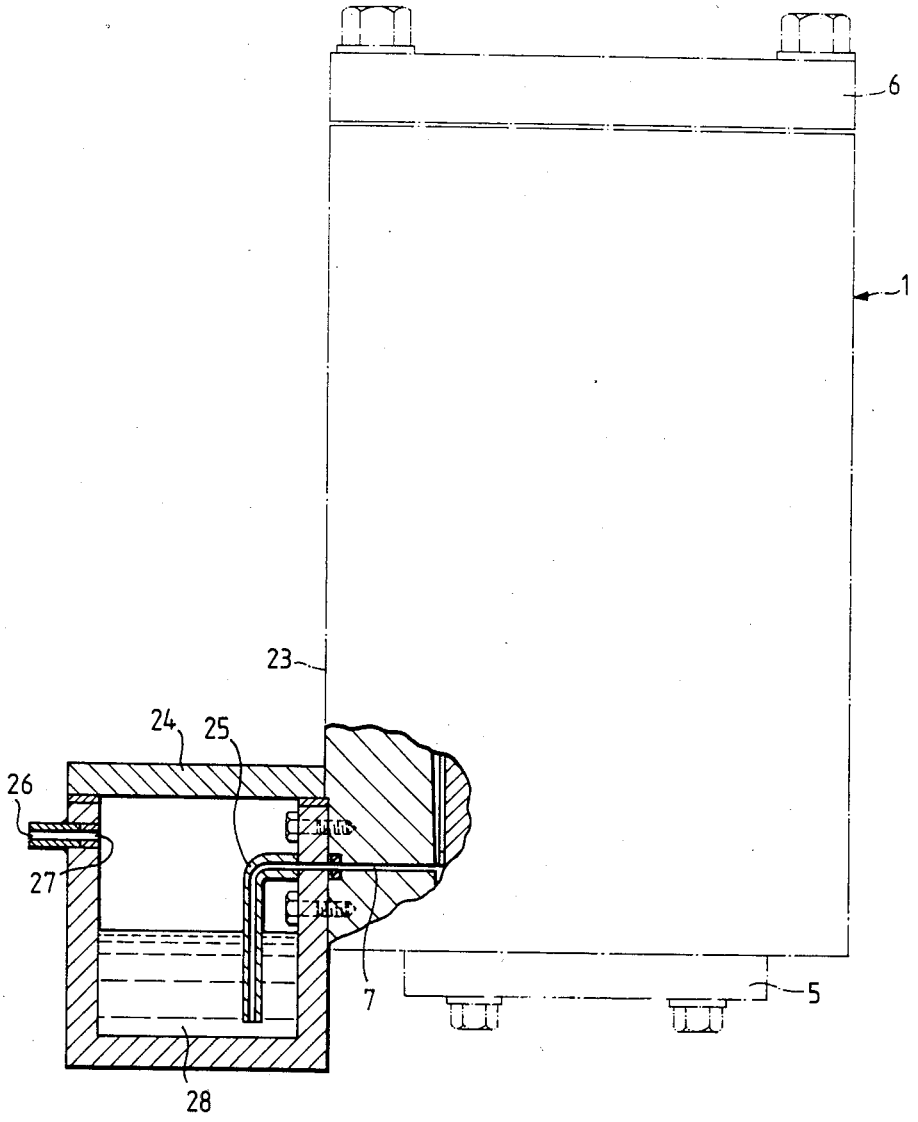
FIG. 4 is a part-sectional view of a modification of the apparatus of FIGS. 1 and 2.

FIG. 4 illustrates a die incorporating a cylindrical former for the reinforcing fibre as shown in FIG. 1. In this embodiment however there is no hole through the top end-plate 6 of the die for evacuation and pressurisation of the mould cavity. In addition the liquid metal valve 11 indicated in FIG. 2 is dispensed with. Connected directly to the outer wall 23 of the die is a furnace 24 the interior of which is connected to the mould cavity by means of the liquid metal conduit or opening 7. A pipe 25 is provided within the furnace having one open end near the bottom of the furnace and the other end thereof connected to the liquid metal conduit or opening 7. A further conduit 26 is connected to an opening 27 near the top of a wall of the furnace 24.

As in the first embodiment a borsic reinforcing fibre is wound on a cylindrical former and the former connected within the outer die body forming a mould cavity between the die body and the former. The furnace 24 and the mould cavity are evacuated via the conduit 26. The furnace 24 may be either a holding furnace, containing a charge of molten metal 28 (as shown), or a melting furnace containing solid metal. In both cases air from the mould cavity is evacuated via the pipe 25 and in the former case bubbles up through the molten metal 28. When the temperature of the die and liquid metal are above the metal liquidus temperature the conduit 26 is connected to an inert gas at atmospheric pressure which thereby forces liquid metal to substantially fill the die cavity. The inert gas is then pressurised, forcing the liquid metal to improve the penetration of the liquid metal into the borsic fibre array.

Figure 5:
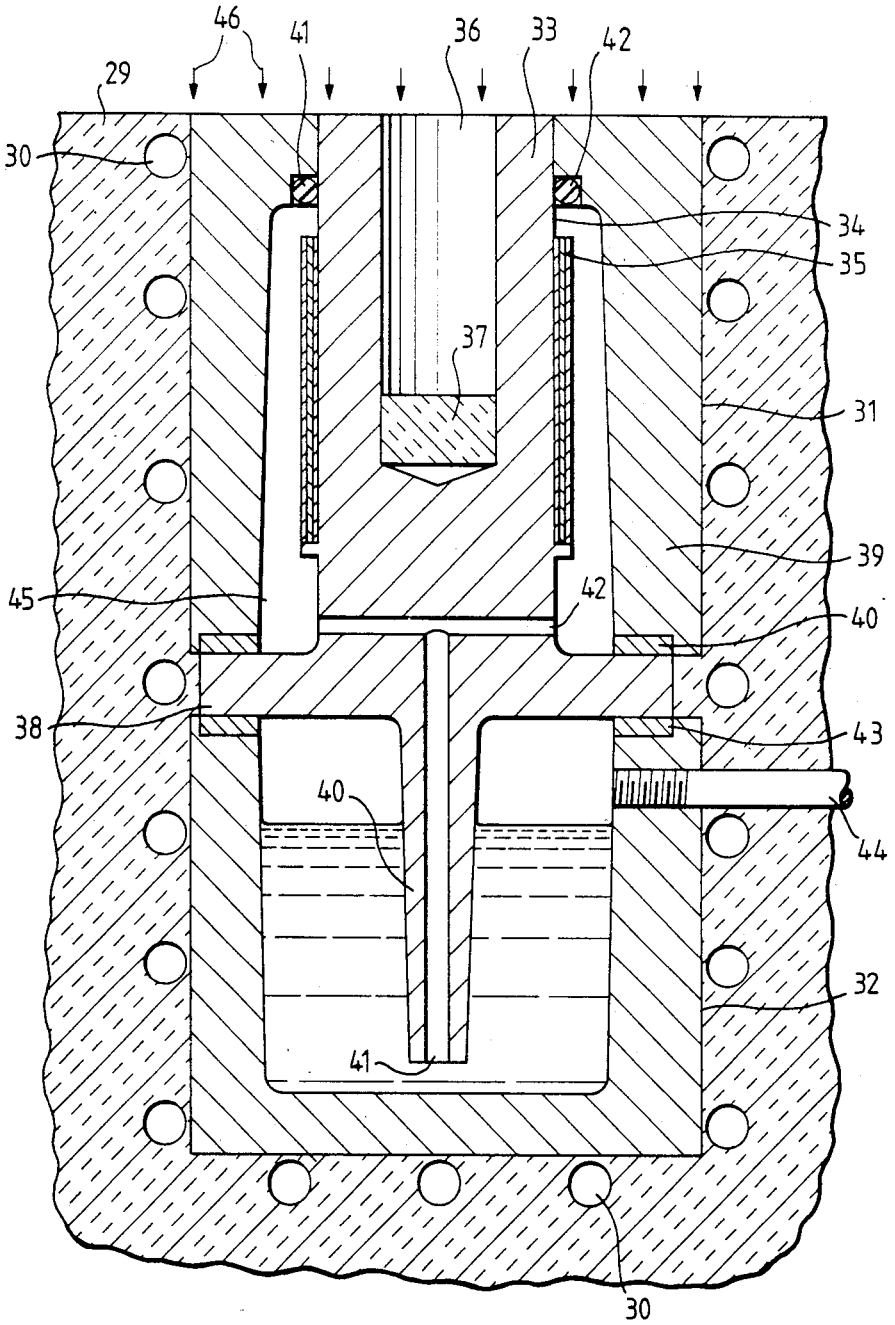
FIG. 5 is a sectional view of an alternative arrangement of the FIG. 4 modification.

FIG. 5 is an alternative apparatus needing no liquid metal valve. Insulation material 29 for surrounding a heating element 30, a die 31 and a furnace 32 is shown partly removed for clarity. A former 33 has a cylindrical upper portion 34 on which a continuous borsic fibre 35 is wound. The upper portion 34 has a hollow bore 36 extending approximately half way through the portion and being filled at its innermost end with insulating material 37. A circular flange 38 integrally formed with the upper portion 34 forms a closure member of the die when the former is inserted into a cylindrical outer die body 39. A circular sealing gasket 40 is provided in the lower end of the die body 40 to seal against the upper surface of the flange 38. A seal 41 is situated in a stepped recess provided at the upper end of the inner surface of the die body 39 to seal against the cylindrical outer surface of the upper portion 34 of the former.

Extending downwards from the circular flange 38 is a stalk 40. An axial bore 41 through the stalk 40 is connected to a metal feed hole 42 which is bored diametrically through the upper portion 34 of the former. The furnace 32, which as before may be a holding furnace or a melting furnace, is provided at the upper end with a circular gasket 43 for sealing against the lower surface of the flange 38. A conduit 44 is provided through the upper wall of the furnace.

As in the FIG. 4 arrangement a borsic fibre is wound on to the upper portion 34 of the former 33 and the former is then assembled within the outer die body 39 forming a die cavity 44. The furnace 32 is then assembled with the die, the length of the stalk 40 being such its open end is near the bottom of the furnace. The furnace and die cavity are then evacuated via the conduit 44, the bore 41 and the metal feed hole 42. After evacuation and with the liquid metal temperature and die temperature above the metal liquidus temperature the conduit 44 is first connected to an inert gas at a low pressure to substantially fill the die cavity 45 with liquid metal and then the inert gas is pressurised to improve the liquid metal penetration into the reinforcing fibre array. Any gas remaining within the die chamber is compressed into a region around the upper die seal 41. After pressurising the die the upper insulation is removed and cooling air 46 is blown onto the upper surface of the die and into the hollow bore 36 within the former 33. The insulating material 37 ensures that cooling occurs through the cylindrical wall of the hollow bore 36 while inhibiting axial cooling of the former which might cause freezing of the liquid metal in the metal feed hole 42. Thus the charge of molten metal in the die cools from the top and further pressurised liquid metal is able to enter the die to fill any cavities which might arise due to differential contraction on cooling and freezing.

Materials investigated for construction of the die body and endplates were mild steel, 18/8 type chromium-nickel stainless steels and nickel-base superalloys. Mild steel was rejected because its properties are inadequate at 650° C. Nickel-base superalloys gave between 50%–100% improvement on yield strength and design strength but castings were up to ten times more expensive. The material chosen was 18% Cr-9% Ni-22% Mo to ASTM A351 CF8M. Preferably the die body and end plates are centrifugally cast. Testing has shown that after various heat treatments the tensile properties of Borsic fibres are unimpaired. The bendability of the fibres was in fact found to improve and thus there is no serious constraint on the time which can be allowed to heat up the die including the fibre array to the operating temperature until it can be evacuated and filled with molten metal.

For small die castings it may prove advantageous to use a split die to facilitate separation of the casting from the die components. For such castings the die structure may be simplified by dispensing with the axial cooling facility.

Although the invention has been described with reference to the accompanying Figures it will be apparent to those skilled in the art that other modifications are possible. Thus the provision of longitudinal grooves on the former could be eliminated by ensuring that the density of fibres in the fibre array is sufficiently low and the gas pressure sufficiently high for molten metal to penetrate the array from one side only and to completely surround the fibres. It is further envisaged that the application of gas pressure in the formation of composite materials may be used to cast shapes other than the tube described. A further improvement in the manufacture of a composite metal tube could be achieved by the use of fibre tapes, woven fibres or bundles of fibres to lay on the former to reduce the time required to wind a single fibre on to the former. In order to minimise the undesirable effects of air leaking through seals into the mould cavity, an inert gas atmosphere could be provided around these seals.

We claim:

1. A process for forming a composite material comprising a metal matrix incorporating a non-metallic fibrous reinforcement material including the steps of providing in a mould chamber at least one layer of the fibrous reinforcement material; connecting the mould chamber via a liquid metal conduit to an air-tight furnace substantially at the base of the mould chamber; evacuating the furnace to thereby evacuate the mould chamber via the metal conduit; heating the mould chamber and fibrous material to a temperature above the solidus temperature of the metal; connecting the furnace to a source of gas at a relatively low pressure to thereby force molten metal immersing the end of the conduit in the furnace to substantially fill the mould chamber under the combined action of the partial pressure in the mould chamber and the relatively low pressure of the gas applied to the molten metal; and finally pressurizing the gas to thereby pressurize the molten metal in the mould chamber so as to force molten metal to surround substantially all of the fibers of the layer.

2. A process according to claim 1 characterized in that there is included the step of cooling the mould chamber while applying the relatively higher pressure to the molten metal, the cooling being controlled to ensure directional solidification of the molten metal.

3. A process according to claim 2 characterized in that the metal is an aluminum alloy.

4. A process according to claim 3 characterized in that the fiber is composed of boron, carbon and silicon.

* * * * *

UNITED STATES PATENT AND TRADEMARK OFFICE

CERTIFICATE OF CORRECTION

PATENT NO. : 4,573,517

DATED : March 4, 1986

INVENTOR(S) : Stuart E. BOOTH; Andrew W. CLIFFORD; Noel J. Parratt

It is certified that error appears in the above—identified patent and that said Letters Patent is hereby corrected as shown below:

On the title page:

In the heading of the patent, between the lines designated "[22]" and "[51]", insert the following:

[30] Foreign Application Priority Data

Feb. 8, 1982 [GB] United Kingdom 8203585

Signed and Sealed this

Twenty-ninth Day of July 1986

[SEAL]

*Attest:*

DONALD J. QUIGG

*Attesting Officer*

*Commissioner of Patents and Trademarks*